US008973661B2

(12) United States Patent
Zhou

(10) Patent No.: US 8,973,661 B2
(45) **Date of Patent: *Mar. 10, 2015**

(54) METHOD OF FRACTURING WHILE DRILLING

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 172 days.

This patent is subject to a terminal disclaimer.

(21) Appl. No.: 13/706,902

(22) Filed: Dec. 6, 2012

(65) Prior Publication Data

US 2013/0161004 A1 Jun. 27, 2013

Related U.S. Application Data

(60) Provisional application No. 61/580,059, filed on Dec. 23, 2011.

(51) Int. Cl.

| | |
|---|---|
| ***E21B 43/26*** | (2006.01) |
| ***E21B 33/12*** | (2006.01) |
| ***E21B 17/07*** | (2006.01) |
| ***E21B 17/16*** | (2006.01) |

(52) U.S. Cl.

CPC ..... *E21B 43/261* (2013.01); *E21B 33/1208* (2013.01); *E21B 43/26* (2013.01); *E21B 17/076* (2013.01); *E21B 17/16* (2013.01)

USPC ..... 166/308.1

(58) Field of Classification Search

USPC ..... 166/308.1, 177.5; 175/317

See application file for complete search history.

(56) References Cited

U.S. PATENT DOCUMENTS

| | | | | |
|---|---|---|---|---|
| 2,783,026 | A | 2/1957 | Reistle, Jr. | |
| 7,334,650 | B2 | 2/2008 | Giroux et al. | |
| 7,503,404 | B2 | 3/2009 | McDaniel et al. | |
| 7,963,325 | B2 * | 6/2011 | Johnson et al. | 166/250.1 |
| 2002/0195248 | A1 | 12/2002 | Ingram et al. | |
| 2004/0129421 | A1 | 7/2004 | Hoffman et al. | |

(Continued)

OTHER PUBLICATIONS

PCT International Search Report and the Written Opinion of the International Searching Authority dated Dec. 20, 2013; International Application No. PCT/US2012/070455; International File Date: Dec. 19, 2012.

(Continued)

*Primary Examiner* — William P Neuder

(74) *Attorney, Agent, or Firm* — Bracewell & Giuliani LLP; Constance Gall Rhebergen; Keith R. Derrington

(57) ABSTRACT

A method of fracturing a formation that at the same time drills a wellbore through the formation selectively deploys a seal from a drill string and pressurizes the wellbore beneath the seal. The seal can be formed by moving sliding blades into channels between cutting blades on a drill bit. The seal can also be a packer on the drill bit that selectively expands radially outward into sealing engagement with the wellbore. At a designated depth in the wellbore, the seal is deployed and fluid is diverted into the space. A pressurizing system pressurizes the fluid so that pressure in the space overcomes the formation strength and fractures the formation adjacent the enclosed space. The packer can be released, drilling can resume, and fracturing can occur at a different depth in the wellbore.

15 Claims, 3 Drawing Sheets

(56) References Cited

U.S. PATENT DOCUMENTS

| | | | | |
|---|---|---|---|---|
| 2005/0230107 | A1 | 10/2005 | McDaniel et al. | |
| 2007/0089909 | A1 | 4/2007 | Freeman | |
| 2007/0284106 | A1 | 12/2007 | Kalman et al. | |
| 2009/0095474 | A1 | 4/2009 | Lesso et al. | |
| 2009/0145660 | A1 | 6/2009 | Johnson et al. | |
| 2009/0151938 | A1* | 6/2009 | Conkle et al. | 166/254.1 |
| 2009/0250207 | A1 | 10/2009 | May | |
| 2009/0321074 | A1 | 12/2009 | Freeman | |
| 2010/0243242 | A1* | 9/2010 | Boney et al. | 166/250.01 |
| 2010/0276206 | A1 | 11/2010 | Borissov | |
| 2011/0107830 | A1 | 5/2011 | Fields et al. | |
| 2011/0226531 | A1 | 9/2011 | Jones | |
| 2011/0253454 | A1 | 10/2011 | Freeman | |

OTHER PUBLICATIONS

U.S. Appl. No. 13/714,485, filed Dec. 14, 2012; System and Method of Fracturing While Drilling.

U.S. Appl. No. 13/711,693, filed Dec. 12, 2012; Drill Bit for Use in Boring a Wellbore and Subterranean Fracturing.

U.S. Appl. No. 13/706,604, filed Dec. 6, 2012; Inflatable Packer Element for Use With a Drill Bit Sub.

* cited by examiner

METHOD OF FRACTURING WHILE DRILLING

CROSS REFERENCE TO RELATED APPLICATIONS

This application claims priority to and the benefit of U.S. Provisional Application Ser. No. 61/580,059, filed Dec. 23, 2011, the full disclosure of which is hereby incorporated by reference herein for all purposes.

BACKGROUND OF THE INVENTION

1. Field of the Invention

The present invention relates to a method for use in producing fluid from a wellbore. More specifically, the invention relates to a method for fracturing discrete portions of a subterranean formation while at the same time drilling a wellbore in the formation.

2. Description of the Related Art

Hydrocarbon producing wellbores extend subsurface and intersect subterranean formations where hydrocarbons are trapped. The wellbores generally are created by drill bits that are on the end of a drill string, where typically a drive system above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid.

Sometimes fractures are created in the wall of the wellbore that extend into the formation adjacent the wellbore. Fracturing is typically performed by injecting high pressure fluid into the wellbore and sealing off a portion of the wellbore. Fracturing generally initiates when the pressure in the wellbore exceeds the rock strength in the formation. The fractures are usually supported by injecting a proppant, such as sand or resin coated particles. The proppant is generally also employed for blocking the production of sand or other particulate matter from the formation into the wellbore.

SUMMARY OF THE INVENTION

Described herein is a method of operations in a subterranean formation. In one example the method includes providing a string of drill pipe with an attached drill bit to define a drill string and forming a wellbore through the formation using the drill string. A seal is formed from a portion of the drill string to a wall of the wellbore to create a sealed space from a bottom end of the wellbore to the seal. By pressurizing the sealed space, a portion of the formation is fractured that is adjacent the sealed space. The method can further include drilling the wellbore to a deeper depth so the bottom end of the wellbore is at a deeper depth and repeating steps of sealing and fracturing. Optionally, the bottom end of the drill bit is drawn upward from the bottom end of the wellbore between the steps of drilling and sealing. In one example, the seal is on the drill bit. The seal can be a packer, in this example forming the seal involves flowing fluid inside the packer to expand the packer into sealing engagement with the wall of the wellbore. In an alternative, the packer is provided on a collar on the drill bit. The bit can include a body with cutting blades on the body that define channels between the cutting blades, and sliding blades that selectively slide into the channels and into sealing engagement with lateral sides of the cutting blades. In this example, forming the seal involves sliding the sliding blades into the channels. The method can further include flowing drilling fluid inside the drill string, and discharging the drilling fluid from the drill bit during the step of forming the wellbore. Alternatively, pressurizing the wellbore is done by directing drilling fluid into the sealed space.

Also disclosed herein is a method of fracturing a subterranean formation. In an example of fracturing, a wellbore is bored in the formation by using a drill string having a drill bit attached to drill pipe. A seal is formed across an annular space between the drill string and a wall of the wellbore that creates a sealed space having an upper end at the seal and a lower end at a bottom end of the wellbore, and fluid is directed into the sealed space at a pressure that imparts a force onto the formation which exceeds a tensile stress in the formation and fractures the formation. The seal can be a packer that is activated by flowing pressurized fluid from an annulus of the drill string to the packer. Alternatively, the seal is formed on the bit by moving sliding blades on the bit into channels defined by cutting blades on the bit, wherein lateral sides of the sliding blades sealingly engage lateral sides of the cutting blades. Optionally, a secondary seal can be deployed above the bit. The bit can be moved upward from a bottom of the wellbore between drilling and sealing the wellbore. In one example, the fluid is a drilling fluid.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
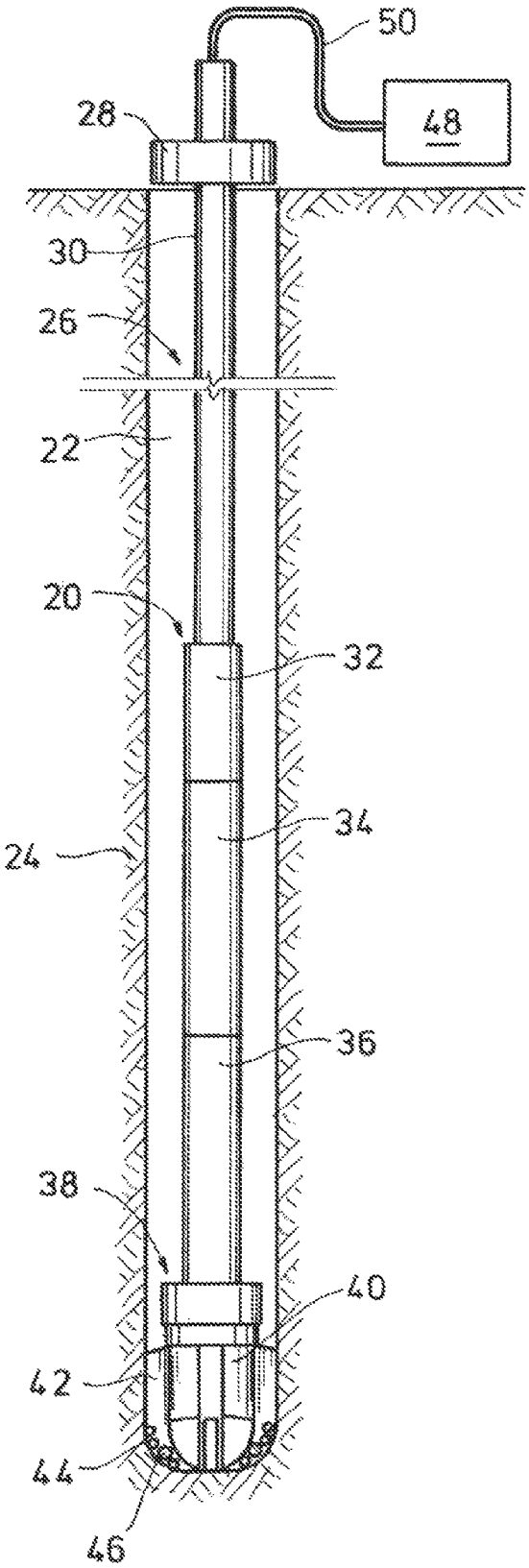
FIG. 1 is a side partial sectional view of an example embodiment of a drilling and fracturing system forming a wellbore in accordance with the present invention.

One example embodiment of a method of fracturing while drilling a wellbore through a formation is shown in a side partial sectional view in FIG. 1. In the example method of FIG. 1 shown is a drilling system 20 excavating a wellbore 22 through a formation 24. The drilling system 20 illustrated includes an elongated drill string 26 that receives a rotational force from a drive system 28 shown schematically represented on the surface and above an opening of the wellbore 22. Example embodiments of the drive system 28 include a top drive as well as a rotary table. A number of segments of drill pipe 30 threadingly attached together form an upper portion of the drill string 26. An optional swivel master 32 is schematically illustrated on a lower end of the drill pipe 30. As is known, implementation of the swivel master 32 allows the portion of the drill string 26 above the swivel master 32 to be rotated without any rotation or torque being applied to the string 26 below the swivel master 32. A directional drilling assembly 34 is shown optionally provided on a lower end of the swivel master 32. The directional drilling assembly 34 may include gyros or other directional type devices for steering the lower end of the drill string 26. Also optionally provided is an intensifier 36 coupled on a lower end of the directional drilling assembly 34.

In one example, the pressure intensifier 36 receives fluid at an inlet adjacent the drilling assembly 34, increases the pressure of the fluid, and discharges the fluid from an end adjacent a drill bit assembly 38 shown mounted on a lower end of the intensifier 36. The bit assembly 38 includes a drill bit 40, shown as a drag or fixed bit, but may also include extended gauge rotary cone type bits. Cutting blades 42 extend axially along an outer surface of the drill bit 40 and are shown having cutters 44. The cutters 44 may be cylindrically shaped members, and may also optionally be formed from a polycrystalline diamond material. Further provided on the drill bit 40 of FIG. 1 are nozzles 46 that are dispersed between the cutters 44 for discharging drilling fluid from the drill bit 40 during drilling operations. As is known, the fluid exiting the nozzles 46 provides both cooling of cutters 44 due to the heat generated with rock cutting action and hydraulically flushes cuttings away as soon as they are created. The drilling fluid also recirculates up the wellbore 22 and carries with it rock formation cuttings that are formed while excavating the wellbore 22. The drilling fluid may be provided from a storage tank 48 shown on the surface that leads the fluid into the drill string 26 via a line 50.

Figure 2B:
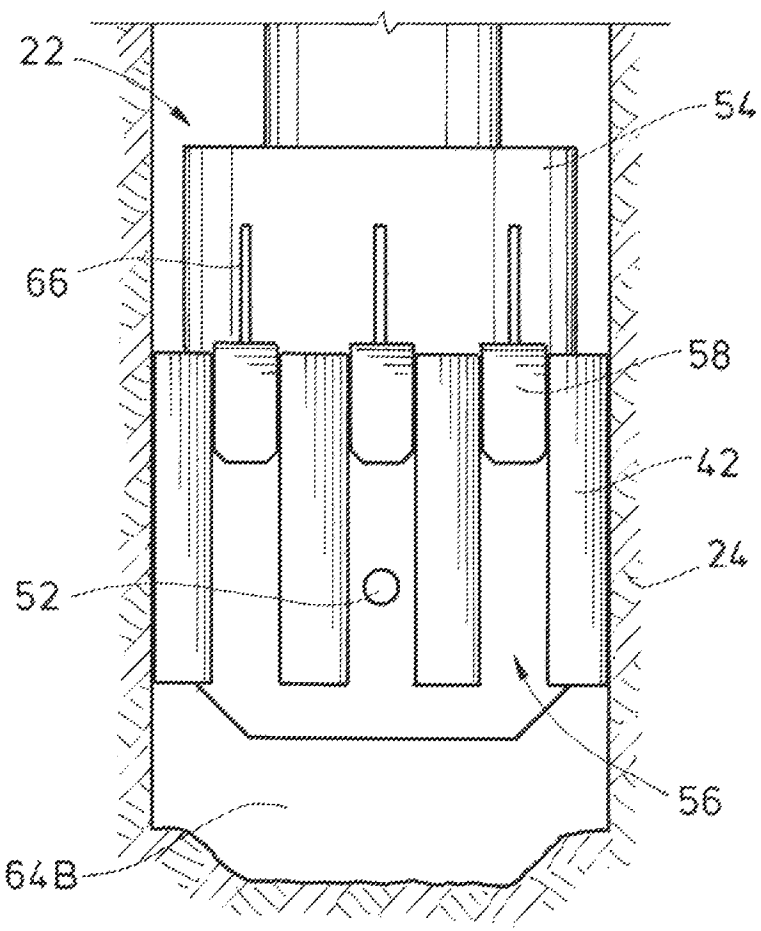
FIG. 2B is a side view of an example of the bit of FIG. 2A in a sealing configuration in accordance with the present invention.
Figure 2A:
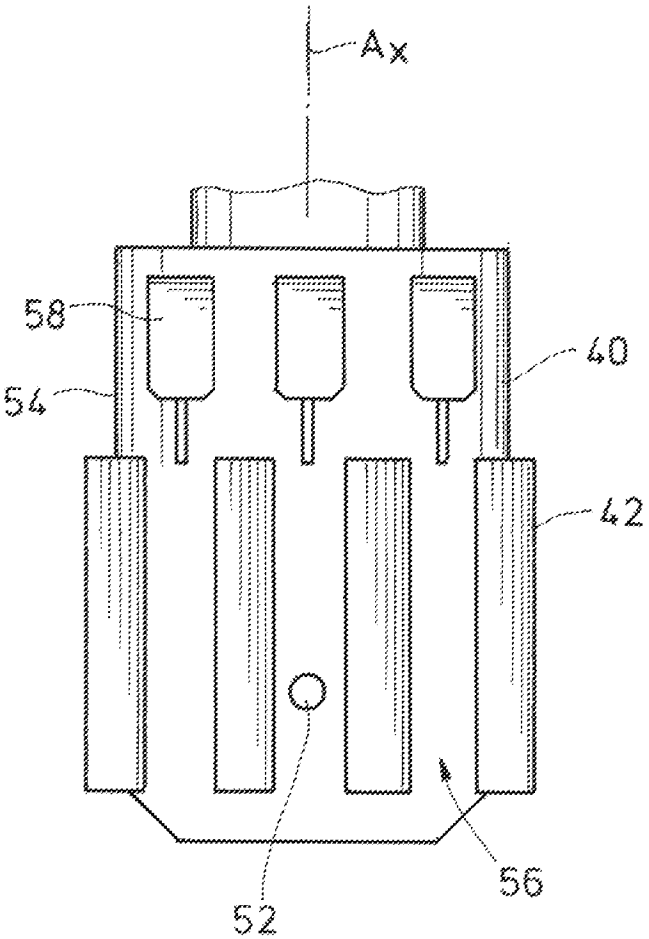
FIG. 2A is a side view of an example of a drill bit for use with the system of FIG. 1 in accordance with the present invention.

FIG. 2A is a side view example of the drill bit 40 that further includes a fracturing nozzle 52 shown formed through a body 54 of the drill bit 40. The nozzles 46 (FIG. 1) and fracturing nozzle 52 are both selectively in fluid communication with fluid provided from the tank 48 and may each be opened or closed at designated times. Fluid in the tank 48 can flow through line 50 and the drill string 26, and then exit the nozzles 46 from the drill bit body 54. In one example embodiment, when the nozzles 46 are in an open condition, the fracturing nozzle 52 is in a closed position so that no fluid flows from the fracturing nozzle 52 through the bit body 54. Conversely, an example of operation exists wherein the fracturing nozzle 52 is in an open position so that fluid exits the fracturing nozzle 52 at a same time that the nozzles 46 are in a closed position and without fluid exiting through the nozzles 46.

Further illustrated in FIG. 2A are elongated spaces between adjacent blades 42 on the bit body 54 that extend substantially parallel with an axis $A_x$ of the bit and define channels 56 along the outer surface of the body 54 between the blades 42. On the body 54 and above upper ends of the blades 42 are sliding blades 58, that as will be described in more detail below, are axially movable from their location as shown in FIG. 2 and into the channels 56. In one example, when the sliding blades 58 are moved into the channels 56, respective lateral sides of the sliding blades 58 and cutting blades 42 sealingly engage one another.

Figure 3:
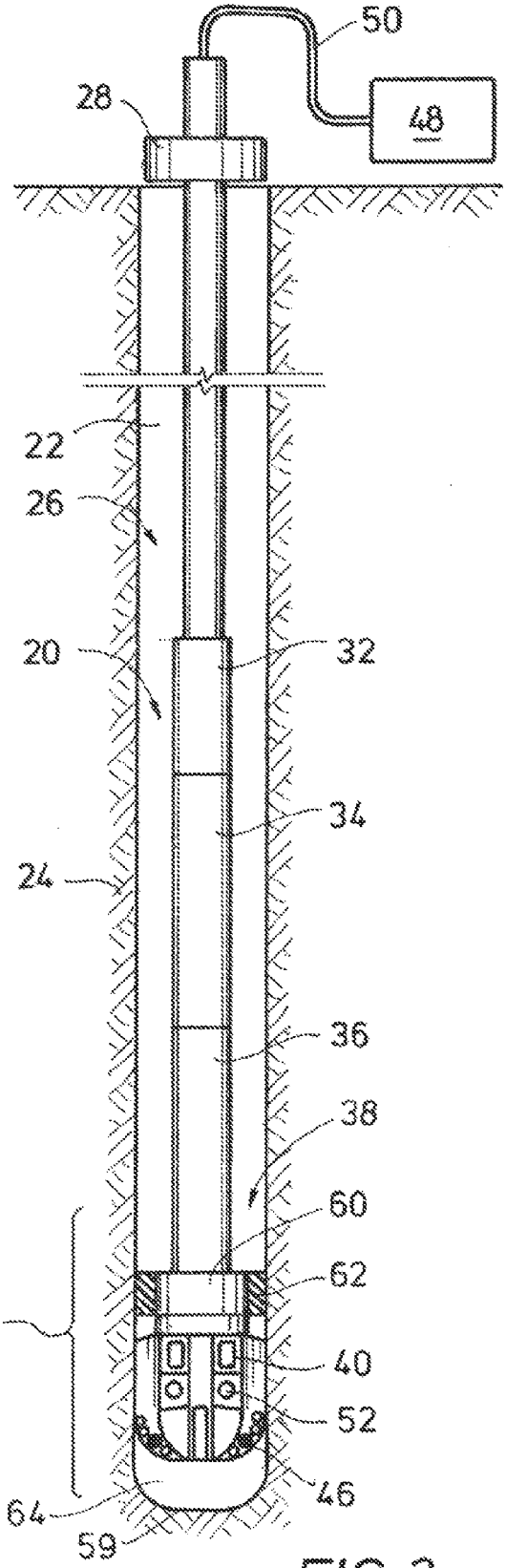
FIG. 3 is a side partial sectional view of an example of the system of FIG. 1 initiating a fracturing sequence in accordance with the present invention.

Referring now to FIG. 3, illustrated is an example of the drilling system 20 (FIG. 1) initiating a sequence for fracturing the formation 24. In the example of FIG. 3, the bit 40 is shown at a depth in the wellbore 22 adjacent a designated zone Z where a fracturing operation is to occur. Identifying the location of zone Z for fracturing can include using real time data, such as surface mud logging, logging while drilling, or downhole data such as rate of penetration (ROP). A sensor or sensors (not shown) at or near the bit 40 may be used to collect the data, and data can be sent uphole via telemetry, including mud pulse telemetry. In this example of fracturing, the nozzles 46 are closed thereby restricting fluid from exiting the bit 40 through the nozzles 46. In contrast and as discussed above, the fracturing nozzles 52 are shown set into an open position so that fluid may be discharged from the bit 40 through the fracturing nozzles 52. Also shown in FIG. 3 is that the drill string 26 has been positioned so that the lower end of the bit 40 is set a distance above a bottom end 59 of the wellbore 22, where the distance may range from less than about a foot up to around 10 feet, and all distances therebetween.

A collar 60 is further illustrated on the drill string 26 and proximate an upper end of the bit 40. On an outer circumference of the collar 60 is a packer 62 that is shown being inflated and expanding radially outward from the collar 60 and into sealing engagement within inner surface of the wellbore 22. The packer 62 when inflated and sealing against the wellbore 22 defines a space 64 between the bit 40 and wellbore 22 that is sealed from portions of the wellbore 22 that are above the collar 60. In the example of FIG. 3, the space 64 extends from the packer to the wellbore bottom 59. In an example, after defining the sealed space 64, fluid is discharged from the fracturing nozzles 52 into the space 64. The fluid pressure in the space 64 exerts a stress on the formation 24 that exceeds a tensile stress in the rock formation 24.

Referring now to FIG. 2B, an example of the bit 40 is shown wherein blades 42 extend radially outward from the bit body 54 and into contact with the inner surface of the wellbore 22. Further shown are that the sliding blades 58 have been moved downward into the channels 56 between the blades 42, thereby occupying a portion of the channels 56. Also, as described above, the opposing lateral sides of the blades 42, 58 engage one another into sealing contact. The sliding blades 58 also extend radially outward into contact with the wall of the wellbore 22 and thus create a seal in the annular space between the bit 40 and wall of the wellbore 22. Slots 66 are shown in the body 54 that each may receive a connecting arm (not shown) attached to an inner surface of the sliding blades 58. The slots 66 can guide the connecting arms, and thus the sliding blades 58, along a designated path. Further, the slots 66 can provide an opening through the body 54, so the connecting arms can couple to an actuator for moving the sliding blades 58. In the example of FIG. 2B, the space 64B extends below the collar 60 and packer 62 and into the spaces between the bit body 54 and inner surface of the wellbore 22 and is smaller than the space 64 (FIG. 3) formed with the configuration of the bit 40 of FIG. 2A. The channels 56 occupy some portion of the sealed space 64B. An advantage of the sliding blades 58 is that because the sealed space 64B is shorter than sealed space 64, even more discrete locations in the wellbore 22 can be fractured.

Figure 4:
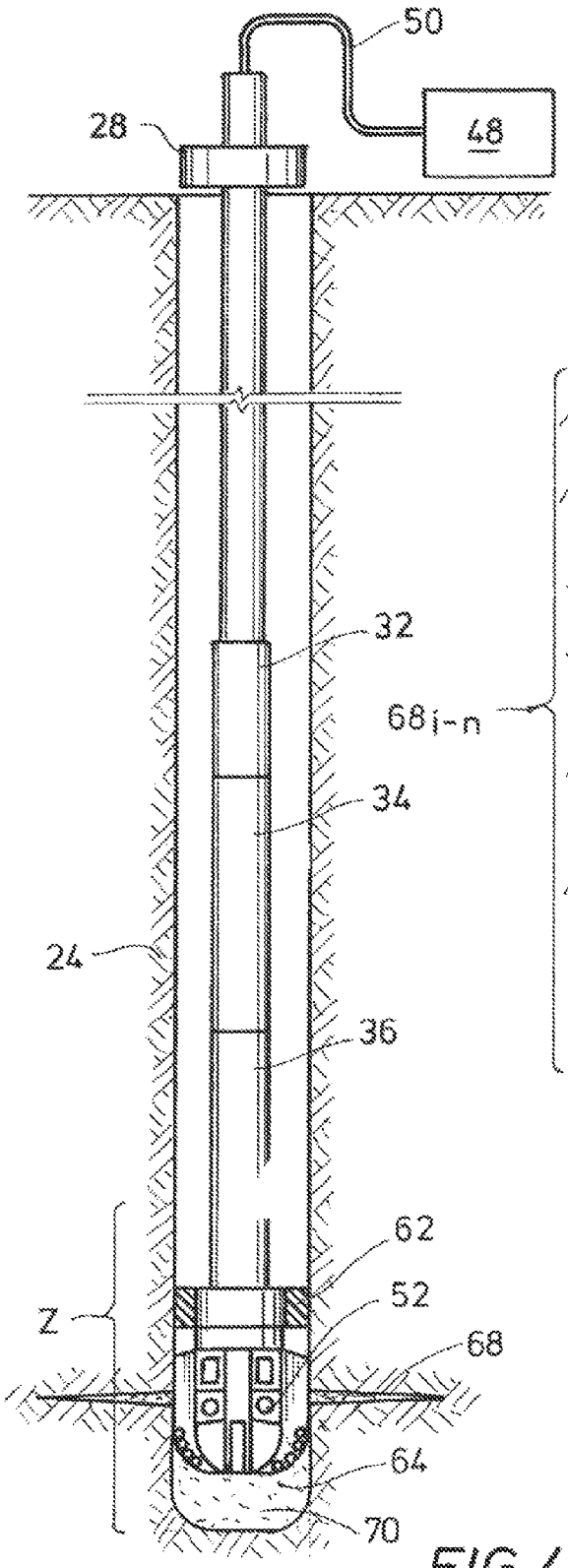
FIG. 4 is a side partial sectional view of an example of the system of FIG. 3 completing a fracturing sequence in accordance with the present invention.

Referring now to FIG. 4, an example of fracturing in the formation 24 is illustrated. A fracture 68, which was initiated at the wellbore wall, is shown extending laterally into the formation 24. The fracture 68 of FIG. 4 can be created by pressurizing fluid 70 in the sealed space 64 to a pressure that exerts a force onto the formation 24 greater than a tensile strength of the formation 24 where the fracture 68 takes place. Examples exist where the sealed space 64 is formed by deploying the packer 62, moving sliding blades 58 into the channels (FIG. 2B) to form space 64B, or both. In one example, the packer 62 acts as a secondary seal to the seal formed by moving the sliding blades 58 between the cutting blades 42. Example pressures in the space 64 may range from about 25,000 psi to about 30,000 psi. The fluid 70 may be partially pressurized at the tank 48 alone, and or may be further pressurized in the intensifier 36. In the example of FIG. 4, the fluid 70 is illustrated in the fracture 68 after having been forced therein from the space 64 below the deployed packer 62. Optionally, the fluid 70 can include drilling fluid, a dedicated fracturing fluid, solid-free acidic brine, combinations thereof, or other non-damaging type of fluid.

In one example, from about 100 barrels to about 150 barrels of fluid are discharged from the fracturing nozzle 52 during the step of fracturing the formation 24. Yet further optionally, a proppant may be included within the fracturing fluid for maintaining the fracture 68 in an open position for enhancing permeability, as well as trapping sand that may otherwise flow into the wellbore 22 from the formation 24. While the fracture 68 is shown to be in a generally horizontal position, other embodiments exist wherein the fractures are oriented to extend along a plane of minimum horizontal principal stress so that multiple transverse fractures can be created that extend further into the rock formation away from the wellbore wall. Further, the swivel master 32 may be initiated during fracturing so that the portion of the drill string 26 above the swivel master 32 may continue to rotate without rotating the portion below the swivel master 32. Rotating the drill string 26 above the swivel master 32 can avoid inadvertent adherence of the drill string 26 to the wall of the wellbore 22. In an alternate embodiment, the drilling may be underbalanced or can be managed pressure drilling for assessing an effect of fracturing the formation. Well control issues due to greater than anticipated fluid migration into the formation from fracturing may be addressed by removing or deactivating the intensifier 36, reducing the volume of the fluid 70, as well as monitoring fluid pressures and flows. Optionally, a sufficient volume of backup drilling fluid can be provided proximate to the drilling system 20 for replacing any lost fluids as well as integrating a rotating control device (not shown) with the drilling system 20.

Figure 5:
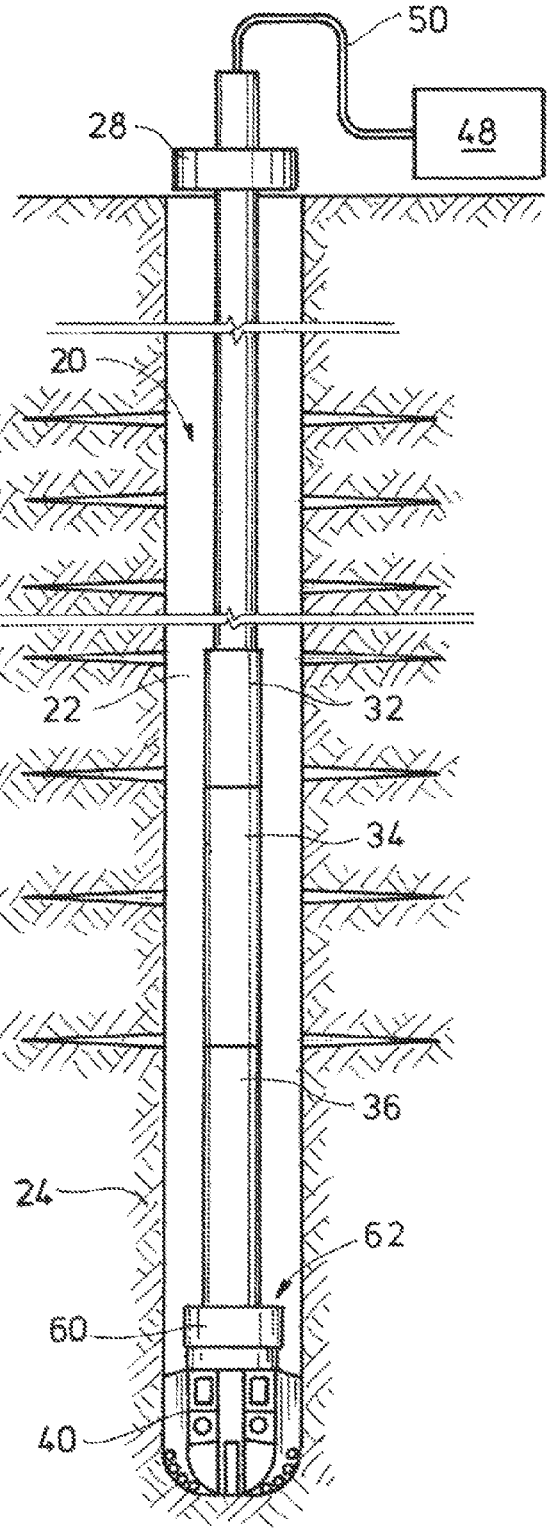
FIG. 5 is a side partial sectional view of an example of the system of FIG. 1 in a wellbore having fractures in multiple zones in accordance with the present invention.

Optionally, as illustrated in FIG. 5, the drilling system 20, which may also be referred to as a drilling and fracturing system, may continue drilling after forming a first fracture 68 and wherein the process of creating a fracture is repeated. As such, in the example of FIG. 6 a series of fractures $\mathbf{68}_{1\text{-}n}$ are shown formed at axially spaced apart locations within the wellbore 22. Further illustrated in the example of FIG. 5 is that the packer 62 has been retracted and stowed adjacent the collar 60 thereby allowing the bit 40 to freely rotate and further deepen the wellbore 22.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of operations in a subterranean formation comprising:

a) providing a string of drill pipe with an attached drill bit to define a drill string;

b) forming a wellbore through the formation using the drill string;

c) forming a seal across a space bounded by the drill bit and a wall of the wellbore by filling spaces between adjacent blades on the drill bit, and which creates a sealed space from a bottom end of the wellbore to the seal;

d) injecting pressurized fluid into the sealed space from the bit to pressurize the sealed space; and e) fracturing a portion of the formation adjacent the sealed space by the step of pressurizing the sealed space.

2. The method of claim 1, further comprising drilling the wellbore to a deeper depth so the bottom end of the wellbore is at a deeper depth and repeating steps (c) and (d).

3. The nettled of claim 1, wherein a bottom end of the drill it is drawn upward from the bottom end of the wellbore between steps (b) and (c).

4. The method of claim 1, wherein the seals is on the drill bit.

5. The method of claim 1. wherein the seal comprises a packer, and method further comprising flowing fluid inside the packer to expand the packer into sealing engagement with the wall of the wellbore.

6. The nettled of claim 5, wherein the packer is provided on a collar on the drill bit.

7. The method of claim 1, wherein the drill bit comprises a body with blades on the body that define channels between the blades and sliding blades that selectively slide into the channels and into seal tag engagement with lateral sides of the blades, and wherein the step of forming the seal comprises sliding the sliding blades into the channels.

8. The method of claim 1, further comprising flowing drilling fluid inside, the drill string, and discharging the drilling fluid from the drill bit during the step of forming the wellbore.

9. The method of claim 1, wherein the step of pressurizing the wellbore comprises directing drilling fluid into the sealed space.

10. A method of fracturing a subterranean formation comprising:

a) boring wellbore in the formation with a drill string that comprises a drill bit attached to drill pipe;

b) forming a seal across an annular spate between a body of the drill bits and a wall of the wellbore that creates a sealed space haying an upper end at the seal and a lower end at a bottom end of the wellbore; and c) directing fluid into the sealed space from a nozzle at a lower terminal end of the drill bit and at a pressure that imparts a force onto the formation which exceeds a tensile stress in the formation and fractures the formation.

11. The method of claim 10, wherein the seal comprises a packer that is activated by flowing pressurized fluid tram an annulus of the drill string to the packer.

12. The method of claim 10, wherein the seal is formed on the bit by moving sliding blades on the bit into channels defined by cutting blades on the bit, wherein lateral sides of the sliding blades sealingly engage lateral sides at the cutting blades.

13. The method of claim 12, further comprising deploying a secondary seal above the bit.

14. The method of claim 10, further comprising moving the bit upward from a bottom of the wellbore between steps (a) and (b).

15. The method of claim 10, wherein the fluid comprises a drilling fluid.

* * * * *

UNITED STATES PATENT AND TRADEMARK OFFICE

CERTIFICATE OF CORRECTION

PATENT NO. : 8,973,661 B2
APPLICATION NO. : 13/706902
DATED : March 10, 2015
INVENTOR(S) : Shaohua Zhou It is certified that error appears in the above-identified patent and that said Letters Patent is hereby corrected as shown below:

In the Claims,

In Column 6, Line 18, Claim 3, the second word appears as “nettled” and should read --method--.

In Column 6, Line 19, Claim 3, the first word appears as “it” and should read --bit--.

In Column 6, Line 22, Claim 4, the word “seals” should read --seal--.

In Column 6, Line 27, Claim 6, the second word appears as “nettled” and should read --method--.

In Column 6, Line 32, Claim 7, the words “seal tag engagement” should read --sealing engagement--.

In Column 6, Line 44, Claim 10, the word “spate” should read --space--.

In Column 6, Line 45, Claim 10, the word “bits” should read --bit--.

In Column 6, Line 46, Claim 10, the word “haying” should read --having--.

In Column 6, Line 53, Claim 11, the word “tram” should read --from--.

Signed and Sealed this
Thirtieth Day of June, 2015

Michelle K. Lee

Michelle K. Lee
*Director of the United States Patent and Trademark Office*